US010006468B2

(12) United States Patent
Fischer et al.

(10) Patent No.: US 10,006,468 B2
(45) Date of Patent: Jun. 26, 2018

(54) TURBOCHARGER BEARING HOUSING WITH CAST-IN PIPES

(71) Applicant: BorgWarner Inc., Auburn Hills, MI (US)

(72) Inventors: Michael Fischer, Kirchheimbolanden (DE); Martin Bihy, Steinbach (DE); Sean Rylance, Barnsley (GB); Rob Daniels, Brighouse (GB); James Finley, Yorkshire (GB)

(73) Assignee: BorgWarner Inc., Auburn Hills, MI (US)

( * ) Notice: Subject to any disclaimer, the term of this patent is extended or adjusted under 35 U.S.C. 154(b) by 864 days.

(21) Appl. No.: 14/387,903

(22) PCT Filed: Mar. 19, 2013

(86) PCT No.: PCT/US2013/032928

§ 371 (c)(1),
(2) Date: Sep. 25, 2014

(87) PCT Pub. No.: WO2013/148411

PCT Pub. Date: Oct. 3, 2013

(65) Prior Publication Data

US 2015/0330405 A1 Nov. 19, 2015

Related U.S. Application Data

(60) Provisional application No. 61/616,025, filed on Mar. 27, 2012.

(51) Int. Cl.

| | |
|---|---|
| ***F04D 29/40*** | (2006.01) |
| ***B22D 19/04*** | (2006.01) |
| ***F04D 17/10*** | (2006.01) |
| ***F04D 29/02*** | (2006.01) |
| ***F04D 29/056*** | (2006.01) |
| ***F04D 29/063*** | (2006.01) |
| ***F01D 25/12*** | (2006.01) |
| ***F01D 25/16*** | (2006.01) |

(52) U.S. Cl.
CPC ..... *F04D 29/403* (2013.01); *B22D 19/045* (2013.01); *F01D 25/125* (2013.01);
(Continued)

(58) Field of Classification Search
CPC ..... F01D 25/125; F01D 25/16; F04D 17/10; F04D 29/023; F04D 29/056;
(Continued)

(56) References Cited

U.S. PATENT DOCUMENTS

| | | | |
|---|---|---|---|
| 5,445,210 | A | 8/1995 | Brassell |
| 2012/0014782 | A1 | 1/2012 | Petitjean et al. |

(Continued)

FOREIGN PATENT DOCUMENTS

| | | | |
|---|---|---|---|
| CN | 1271403 | A | 10/2000 |
| CN | 1276469 | A | 10/2000 |

(Continued)

OTHER PUBLICATIONS

Chinese Office Action (with English language translation) dated Jan. 25, 2017, in Chinese Patent Application No. 201380013646.7.

(Continued)

*Primary Examiner* — Igor Kershteyn
(74) *Attorney, Agent, or Firm* — Eric L. Doyle; Stephan A. Pendorf; Patent Central LLC

(57) ABSTRACT

Conventionally, turbocharger bearing housings are cast, and then oil passageways are drilled or bored into the casting. As a result, bores are limited to straight lines extending from drill access points. Greater design flexibility is provided by pre-staging in a mold a collection of metal pipes which will define one or more of oil, air and water galleries, and then casting a bearing housing around the pipes. This provides almost unlimited freedom in shaping and locating the oil bores and other features.

17 Claims, 5 Drawing Sheets

(52) U.S. Cl.
CPC ..... *F01D 25/16* (2013.01); *F04D 17/10* (2013.01); *F04D 29/023* (2013.01); *F04D 29/056* (2013.01); *F04D 29/063* (2013.01); *F05D 2220/40* (2013.01); *F05D 2300/171* (2013.01)

(58) Field of Classification Search
CPC ... F04D 29/062; F04D 29/403; B22D 19/045; F05D 2220/40; F05D 2300/171
See application file for complete search history.

(56) References Cited

U.S. PATENT DOCUMENTS

| | | | | |
|---|---|---|---|---|
| 2013/0142647 | A1* | 6/2013 | Hornbach | F01D 25/162 415/229 |
| 2014/0369811 | A1 | 12/2014 | Malins et al. | |

FOREIGN PATENT DOCUMENTS

| | | | | |
|---|---|---|---|---|
| CN | 101506491 | A | 8/2009 | |
| CN | 104040143 | A | 9/2014 | |
| DE | 19925779 | A1 * | 12/2000 | F01D 25/18 |
| JP | 2011058393 | | 3/2011 | |
| KR | 20010056316 | A | 7/2001 | |
| KR | 100641621 | | 11/2006 | |
| WO | 2012027188 | | 3/2012 | |

OTHER PUBLICATIONS

Chinese Office Action (with English language translation) dated Mar. 18, 2016, in Chinese Patent Application No. 201380013646.7.

* cited by examiner

TURBOCHARGER BEARING HOUSING WITH CAST-IN PIPES

BACKGROUND OF THE INVENTION

Field of the Invention

This invention relates to turbochargers, and in particular provides a bearing housing with the oil, water and air galleries formed by casting the bearing housing casting material around pre-staged pipes.

Description of the Related Art

Turbochargers extract energy from a vehicle exhaust to drive a compressor to deliver air at high density to the engine intake, allowing more fuel to be combusted, thus boosting the engine's horsepower. The rotating assembly of the turbocharger, comprising turbine wheel, compressor wheel, and shaft, may rotate at 80,000 RPM to 300,000 RPM. The shaft rotates on a hydrodynamic bearing system. Oil is fed, under pressure, to an oil fitting in top of the bearing housing, from which it travels in oil bores to the journal bearings (33, 34) and the thrust bearing (35).

Conventionally, a bearing housing is cast without oil bores. The bores are subsequently machined into the bearing housing by drilling along a straight line. Typically a drill guide is used to support a drill or boring tool, and drilling access for this drill guide (94, 95) can only be through the axially open ends of the relatively small-diameter journal bearing bore (65) of the bearing housing. This is a very awkward machining feat often requiring intricate tooling as the drill must first start, at a very shallow angle, at the correct place in the journal bearing bore, and then break through the as-cast oil delivery bore. Due to limited access for the drilling tool, the resulting bore for delivering oil to the journal bearing is at an angle to the journal bearing bore and located close to the end of the bearing housing.

The thrust bearing oil feed bore (69) is also a straight line bore that typically must intersect not only the two journal bearing oil feed bores (67, 68), but also the feed bore (62) from the oil inlet. The resultant of these geometry of these bores is typically that the breakout of the thrust bearing oil feed bore (69) in the thrust bearing mounting face (85) is at a larger offset from the centerline than is desirable, in particular because this results in the canal of the thrust bearing being at a larger radius from the turbocharger centerline than desired, as a result of which the thrust bearing must be larger than desired, which elevates the material cost.

Most turbochargers mount to the engine via the turbine housing foot. In some cases, instead of oil being fed via a pressurized tube or pipe to a fitting on top of the bearing housing, the turbochargers are mounted to an engine mount via a foot which extends from the bottom of the bearing housing and includes a connection through which pressurized engine oil is fed to the bearing housing and a connection for draining the bearing housing to a cavity within the engine component. Connections may also be provided for water-cooling the bearing housing.

A problem with such configurations is that the oil feed must travel vertically up from the bearing housing foot (70), across to a point above each journal bearing, and then vertically down into the journal bearings. With the current state of the art, several drillings are required to describe the oil flow path. This also means that some oil bore drillings have to be drilled from outside the bearing housing to intersect other bores; and then the unused part of the bore must be sealed off with plugs to complete the oil flow circuit. Such a manufacturing method also means that corners in the flow path are sharp with no radius to very little radius, which is not conducive to good fluid flow with low losses.

Further, potentially damaging metal burrs are produced by this metal-removing manufacturing method, and also as a result from the break-through of the bores into one another. Once machined, the areas in which the minor machined oil delivery bores breakout into the major gallery must be completely deburred to prevent metal burrs from entering the oil flow into tightly toleranced bearing clearances. Failure to deburr these areas well could result in a metal burr entering the bearing and destroying it. These bores are thus time consuming to fabricate, and there always exists the potential for a plug to fall out and thus release engine oil, at pressure, into the very hot environment around the engine and turbocharger.

So it can be seen that there exists the need for a better way of providing oil feed bores in a turbocharger to minimize the complex and difficult machining operations.

SUMMARY OF THE INVENTION

The present invention solves the above problems by pre-staging a collection of pipes which will define one or more of oil, air and water galleries, and then casting a bearing housing around the pipes.

Not only are the problems associated with straight-line machining of features into the bearing housing subsequent to the casting process avoided, but the present invention for the first time provides almost unlimited freedom in shaping and locating the oil bores and other features.

BRIEF DESCRIPTION OF THE DRAWINGS

The present invention is illustrated by way of example and not limitation in the accompanying drawings in which like reference numbers indicate similar parts, and in which.

DETAILED DESCRIPTION OF THE INVENTION

In a first embodiment of the invention, a pre-fabricated bundle of pipes is staged in a mold and the bearing housing (60) is cast around these pipes, thus providing smooth bore, curved internal oil galleries without the need for the complicated, difficult, expensive machining of the typical bearing housing oil delivery bores. This also means that pressure drops due to acute changes in flow direction and sharp edges are kept to a minimum.

Pipes may be joined (typically cast or welded) together to form the "pipe bundle". The joints must be sufficiently robust so as to stay together through the casting process when the molten cast iron is introduced into the mold so that the pieces are not dislodged from one another; and the joint must be tight enough that the molten cast iron does not leak into the inside of the pipe bundle.

The pipes may be made of any metal that does not melt through during the iron casting process, and is preferably steel. The steel used in the pipe bundle should be low carbon (<0.1%), which makes it sufficiently ductile and quite malleable, so it is easy to manipulate into the pipe bundle architecture with gentle curves. Similar to the manner in which chaplets are used in the cast iron casting process, the pipe bundle must be oxidation free and may be coated with a thin layer of a foundry dressing, tin, or copper to ensure maximum fusion with the incoming cast iron. Because the pipe bundle is full of air (since it is fabricated simply of pipe, which has an outer casing but air in the middle) the bundle must be securely constrained in the cores for the bearing housing so that it does not float in the molten iron into an undesirable position.

The melting point of grey iron is from 1150° C. to 1200° C., and the melting point of ductile cast iron is 1148° C. The melting point of low carbon steel is from 1371° C. to 1410° C., so low carbon steel makes a good fusion, or welded, joint when molten grey or ductile iron is introduced around it. To produce good fusion, the melting point of the pipe bundle must be greater than that of the incoming cast iron, so, by using low carbon steel for the pipes and cast iron for the bearing housing base metal, these conditions are met.

Figure 1:
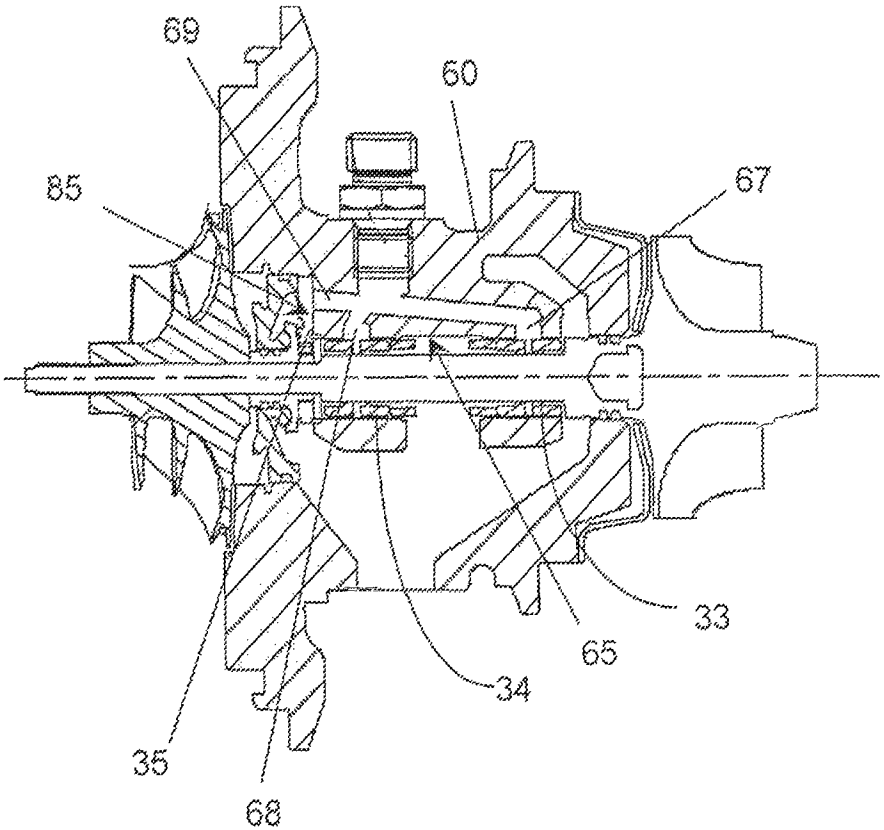
Fig. 1 Prior Art
FIG. 1 depicts a section of a typical turbocharger bearing housing assembly.
Figure 2:
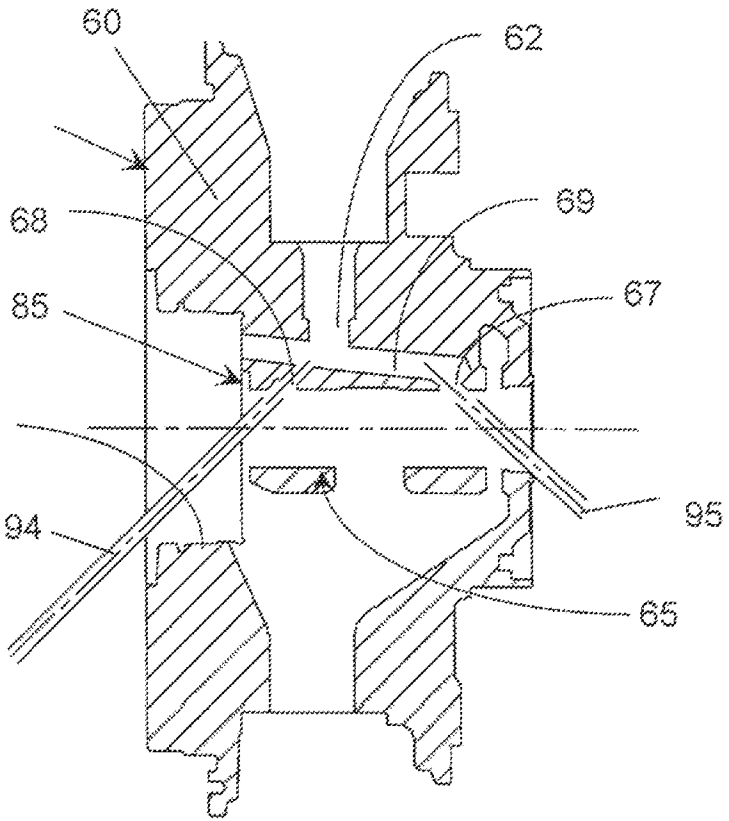
Fig. 2 Prior Art
FIG. 2 depicts a section view of a typical turbocharger journal bearing oil feed boring scheme.
Figure 3B:
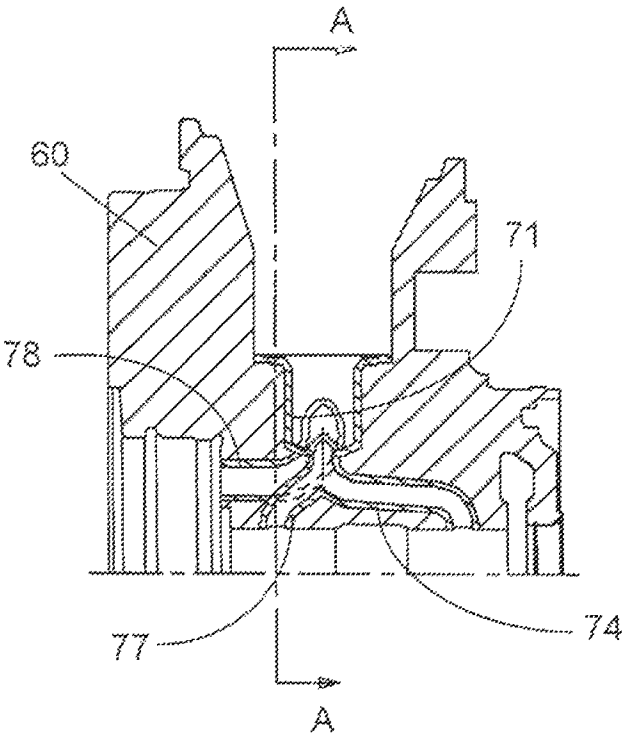
FIGS. 3A,B depicts two half section views showing the inventive cast-in pipes.
Figure 3A:
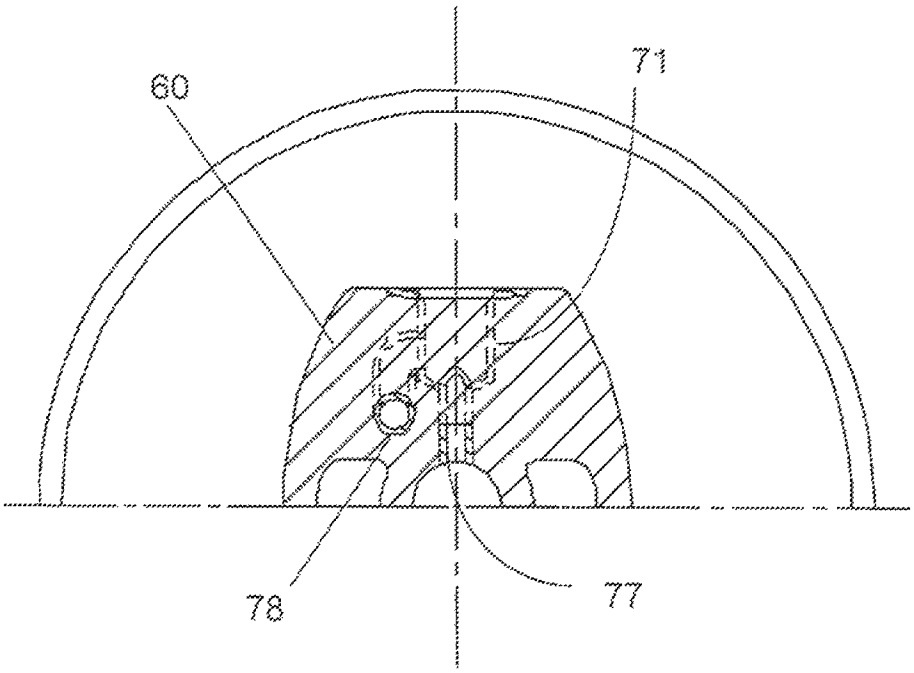
Figure 4:
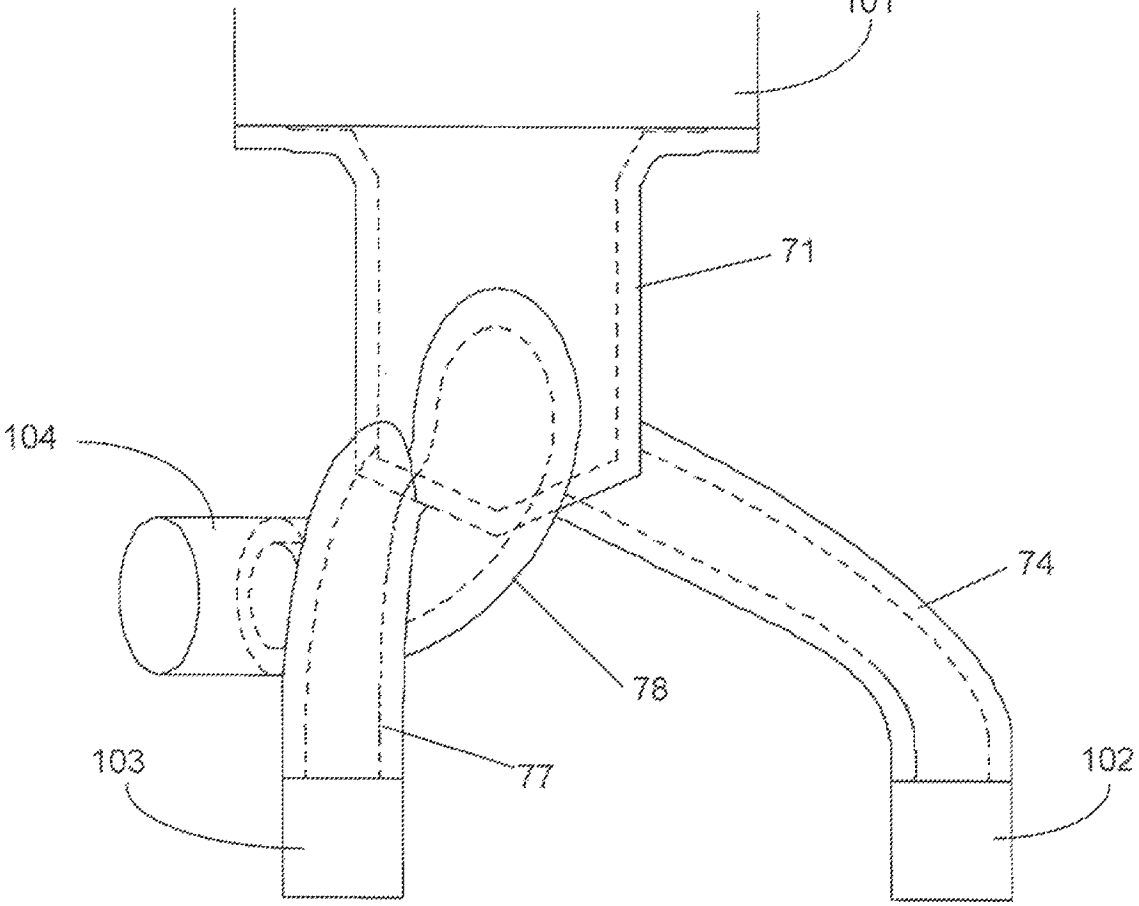
FIG. 4 depicts a view of the pipe bundle.

In a first embodiment of the invention, as depicted in FIGS. 1, 3A and 3B, pipes (74, 77) shaped to fluidly connect the turbine-end journal bearing (33) and the compressor-end journal bearing (34) with the oil inlet (71) are fabricated and joined together. A pipe shaped to fluidly connect the thrust bearing (35) with the oil inlet (71) is also joined to the oil inlet. In FIG. 4, a pipe bundle consisting of the aforementioned pipes is depicted as a single entity. Each of the fluidly connecting pipes (71, 74, 77 and 78) has affixed to it a blanking and positioning cap, respectively (101, 102, 103, 104). The function of the caps is to prevent any molten cast iron from entering the pipe bundle and also to locate and constrain the pipe bundle in the cores for the casting of the bearing housing. This assembly of pipes is physically placed in the mold for a bearing housing, and molten cast iron is poured around the pipe bundle, encapsulating it.

When the bearing housing is machined, the caps are machined off, leaving smooth-bore oil galleries fluidly connecting the various bearings with the oil inlet.

Figure 5B:
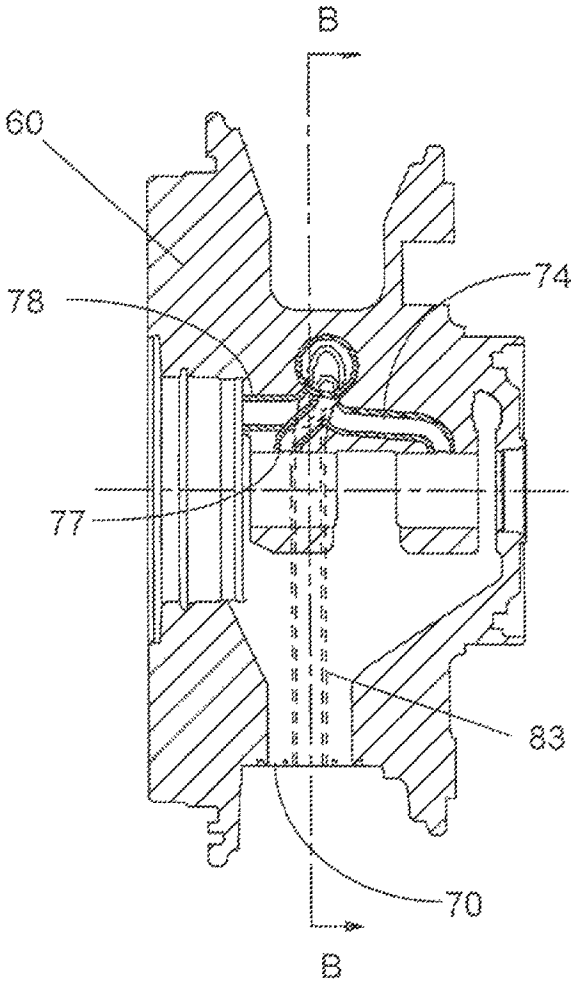
FIGS. 5A,B depict section views showing the pipe scheme for a bottom-fed bearing housing.
Figure 5A:
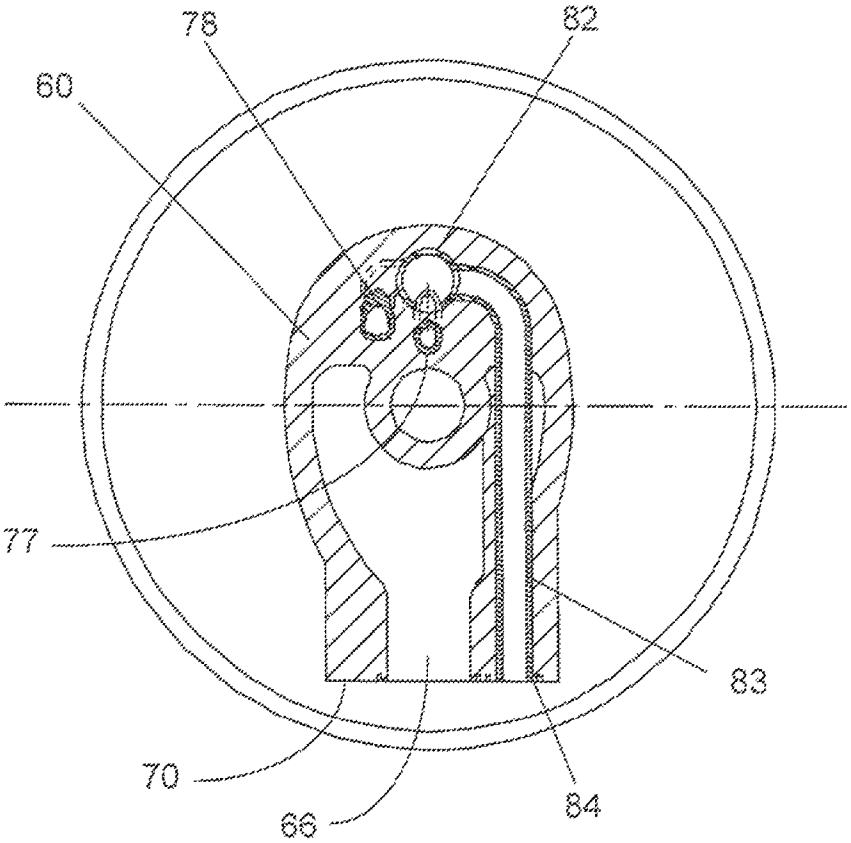

In a variation to the first embodiment of the invention, as depicted in FIGS. 5A and 5B, a bottom fed bearing housing has an oil pressure feed pipe (83) fluidly coupling the foot (70) of the bottom of the bearing housing with a reservoir (82) near the top of the bearing housing. The reservoir (82) is fluidly coupled to the turbine-end journal bearing (33), the compressor-end journal bearing (34), and the thrust bearing (35). FIG. 5B is a section along plane "B-B", cutting the vertical pipe from the lower surface (70) of the bearing housing through a reservoir (82). This section ("B-B") is depicted in FIG. 5A. The function of the reservoir is to retain some oil when the engine is shut off and to provide space for the various pipes to intersect. The system of a bottom fed bearing housing need not have the reservoir (82), in which case it could have the feeder pipe (83), from the bottom of the bearing housing, fluidly couple directly into one of the other pipes (74,77,78) as long as the feeder pipe (83) is still fluidly coupled to the three bearings (33, 34, 35).

Now that the invention has been described,

We claim:

1. A method of manufacturing a turbocharger bearing housing, the method comprising:

preparing a pipe bundle (71, 74, 77, 78) including at least a first pipe directly supplying a turbine-end journal bearing and at least a second pipe directly supplying a compressor-end journal bearing, and casting the bearing housing (60) around the pipe bundle to form a bearing housing within which said first and second pipes are encased and respectively positioned for supplying said turbine-end journal bearing and compressor-end journal bearing.

2. The method according to claim 1, wherein said pipe bundle further comprises a thrust bearing oil feed pipe.

3. The method according to claim 1, wherein said pipe bundle defines a turbine-end journal bearing oil feed pipe, a compressor-end journal bearing oil feed pipe, and a thrust bearing oil feed pipe.

4. The method according to claim 1, wherein said turbocharger bearing housing includes bores for receiving compressor side and turbine side journal bearings and a foot adapted to mating engagement with an engine mount, further comprising at least one pipe which extends from the foot to a connection point above the journal bearings bores, at which connection point it is fluidly coupled to said turbine-end journal bearing oil feed pipe, said compressor-end journal bearing oil feed pipe, and a thrust bearing oil feed pipe.

5. The method as in claim 4, wherein said connection point serves as an oil reservoir.

6. The method as in claim 4, wherein said pipe bundle further comprises a drain pipe for draining the bearing housing through said foot.

7. The method according to claim 1, wherein at least one pipe of said pipe bundle defines an air gallery.

8. The method according to claim 1, wherein at least one pipe of said pipe bundle defines a water gallery.

9. A turbocharger bearing housing comprising:

a pipe bundle (71, 74, 77, 78) made of a first metal and including at least a first pipe directly supplying a turbine-end journal bearing and at least a second pipe directly supplying a compressor-end journal bearing, and a bearing housing structure (60) comprised of a second metal cast around the pipe bundle to form a bearing housing within which said first and second pipes are encased and respectively positioned for supplying said turbine-end journal bearing and compressor-end journal bearing.

10. The turbocharger bearing housing according to claim 9, wherein said pipe bundle further comprises a thrust bearing oil feed pipe.

11. The turbocharger bearing housing according to claim 9, wherein said pipe bundle defines a turbine-end journal bearing oil feed pipe, a compressor-end journal bearing oil feed pipe, and a thrust bearing oil feed pipe.

12. The turbocharger bearing housing according to claim 9, wherein said turbocharger bearing housing includes a bore for receiving compressor side and turbine side journal bearings and a foot adapted to mating engagement with an engine mount, further comprising at least one pipe which extends from the foot to a connection point above the journal bearings bores, at which connection point it is fluidly coupled to said turbine-end journal bearing oil feed pipe, said compressor-end journal bearing oil feed pipe, and a thrust bearing oil feed pipe.

13. The turbocharger bearing housing as in claim 12, wherein said connection point serves as an oil reservoir.

14. The turbocharger bearing housing as in claim 12, wherein said pipe bundle further comprises a drain pipe for draining the bearing housing through said foot.

15. The turbocharger bearing housing as in claim 9, wherein at least one pipe of said pipe bundle defines an air gallery.

16. The turbocharger bearing housing as in claim 9, wherein at least one pipe of said pipe bundle defines a water gallery.

17. A method of manufacturing a turbocharger bearing housing, the method comprising:

preparing a pipe bundle (71, 74, 77, 78) including at least a first metal pipe directly supplying a turbine-end journal bearing and at least a second metal pipe directly supplying a compressor-end journal bearing, and casting the bearing housing (60) around the pipe bundle to form a bearing housing within which said first and second metal pipes are encased and respectively positioned for supplying said turbine-end journal bearing and compressor-end journal bearing.

* * * * *